United States Patent [19]

Albrecht et al.

[11] Patent Number: 4,485,748

[45] Date of Patent: Dec. 4, 1984

[54] SEWING MACHINE WITH A STOP FOR THE MATERIAL TO BE SEWN

[75] Inventors: Ernst Albrecht; Karl Barth, both of Hochspeyer, Fed. Rep. of Germany

[73] Assignee: Pfaff Industriemaschinen GmbH, Fed. Rep. of Germany

[21] Appl. No.: 475,328

[22] Filed: Mar. 14, 1983

[30] Foreign Application Priority Data

Apr. 8, 1982 [DE] Fed. Rep. of Germany ... 8210077[U]

[51] Int. Cl.[3] ..... D05B 3/14

[52] U.S. Cl. ..... 112/110; 112/153

[58] Field of Search ..... 112/110, 114, 235, 153, 112/151

[56] References Cited

U.S. PATENT DOCUMENTS

| | | | |
|---|---|---|---|
| 2,043,929 | 6/1936 | McCann | 112/110 |
| 2,175,247 | 10/1939 | Brussell | 112/110 |
| 2,298,246 | 10/1942 | McCann | 112/110 |
| 2,509,619 | 5/1950 | Vollman | 112/110 |
| 3,509,838 | 5/1970 | Brown | 112/110 |

*Primary Examiner*—H. Hampton Hunter

*Attorney, Agent, or Firm*—McGlew and Tuttle

[57] ABSTRACT

A sewing machine comprises a sewing machine support arm with a cloth feeding plate mounted on the support arm over which the material to be sewn is fed. A stop element is mounted on the support arm and it overlies the cloth feeding plate and it includes a portion which defines a material stop against which the material to be sewn may be positioned. The stop is made of a compressible material and it is compressible in the direction toward the feeding plate. A presser plate associated with the machine may advantageously be in the form of a button clamp may be moved downwardly into engagement with the stop which is raised slightly above the material and compress it downwardly until the plate clamps the material in place for the sewing operation.

8 Claims, 2 Drawing Figures

SEWING MACHINE WITH A STOP FOR THE MATERIAL TO BE SEWN

FIELD AND BACKGROUND OF THE INVENTION

This invention relates in general to sewing machines and in particular to a new and useful stop for the material which is to be sewn which is adapted to cooperate with a presser plate which moves downwardly against the stop and which includes a surface against which the material to be sewn is fed which is made of a compressible material so that it may be contacted by the presser plate and moved downwardly to permit the plate to firmly engage and hold the material to be sewn.

In a known sewing machine, the stop element projecting under the presser element for the sewing material has a predetermined thickness. The thickness of the stop element must be so dimensioned that it is positively below the thickness of the sewing material to be applied in the compressed state to ensure sufficient clamping of the sewing material by the presser element. On the other hand, the height of the stop element must be large enough to provide a sufficient stop surface for the sewing material to be applied. When sewing materials of different thickness, the known model has the drawback that the above-mentioned requirements cannot always be met. There is also a risk that a part of the sewing material will move during the compression by the present element between the pressing element and the stop element, and be clamped there. Consequently, a number of stop elements, which are adapted to the thickness of the sewing material, must be kept in stock in the known arrangement.

SUMMARY OF THE INVENTION

The invention provides a stop element that can be used for all sewing material thicknesses.

In accordance with the invention, the resilient stop element is made resilient so that a maximum height of the stop surface is available as a stop for the sewing material, which then diminishes to the thickness of the sewing material when the presser element is applied.

Accordingly it is an object of the invention to provide an improved sewing machine stop element in the form of a compressible plate against which the material to be sewn is positioned which may be compressed by a presser plate so that the plate may move downwardly and firmly hold the material to be sewn.

A further object of the invention is to provide a stop element and presser plate combination which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
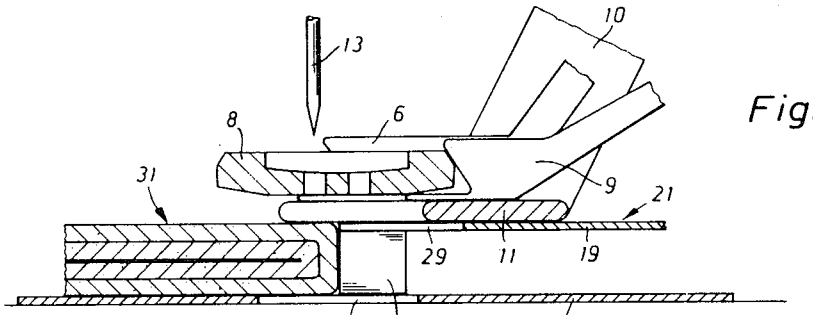
FIG. 2 is an enlarged partial sectional view of the sewing machine shown in FIG. 1 indicating the button clamp in a clamping position with respect to the material to be sewn.

Referring to the drawings in particular the invention embodied therein comprises a sewing machine having a support arm 1 with a cloth feeding plate 2 mounted on the arm over which the material to be sewn is fed. In accordance with the invention, a stop 21 is provided which includes a retaining arm 19 having resilient portions for example, lateral arms 24 and 25 which define a stop surface 26 against which the material to be fed is positioned. In accordance with a feature of the invention, the stop is made of a compressible material and it is compressible in the direction toward the cloth feeding plate 2. The stop 21 cooperates with a presser plate 11 which in the embodiment shown is part of a button clamp 4. The presser plate 11 includes a portion which overlies the stop elements 24 and 25 and a portion which extends beyond the edge 26 in the direction of the material 31 which is to be fed. The presser plate 11 is moved downwardly and it first compresses the stop until the outer portion of the presser plate 11 contacts the material 31 and compresses and holds the material in position.

Figure 1:
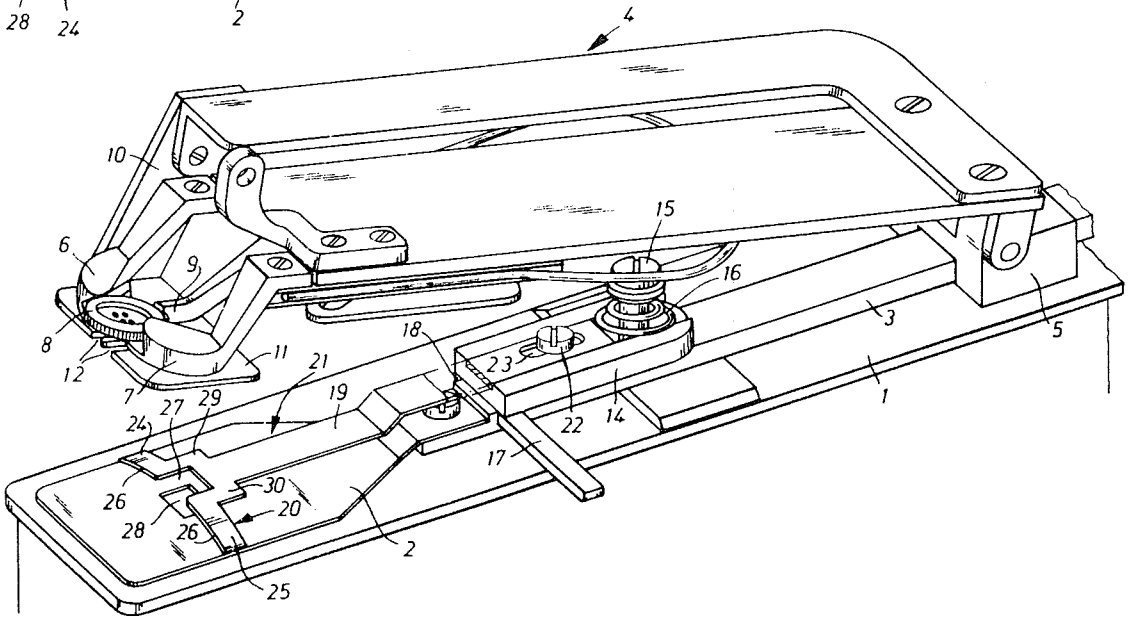
FIG. 1 is a partial top perspective view of a cloth supporting plate of a sewing machine having a button clamp with a material stop constructed in accordance with the invention.

FIG. 1 shows a part of a cloth or material supporting arm 1 of a button sewing machine, a cloth or material feeding plate 2 with a pushrod 3, and a button clamp 4. Button clamp 4 is pivotally mounted on a bearing block 5 secured on pushrod 3. Pushrod 3 is connected with the control mechanism of the sewing machine in a manner not shown here.

Button clamp 4 has two spring-loaded clamping jaws 6 and 7 which grip laterally a button 8 to be sewn on as well as a stop 9, which determines how far button 8 is pushed-in between clamping jaws 6 and 7. Underneath clamping jaws 6 and 7 extends a cloth pressure plate 11 connected with button clamp 4, which has cutouts 12 for the passage of a needle 13 of the sewing machine shown in FIG. 2.

A carrier 14 is articulated on pushrod 3 by means of a collar screw 15. A spring 16 arranged on collar screw 15 presses carrier 14 toward pushrod 3, whereby one end of a handlebar 17 and a stop 18, which are both secured on the underside of carrier 14, serve as a safety mechanism to prevent carrier 14 from turning.

On carrier 14 is secured by means of a screw 22 in a slot 23 of spring plate 21. The plate 21 includes a retaining arm 19 and a stop element 20. The screw 22 projects through an oblong slot 23 in the retaining arm 19.

Stop element 20 includes two arms 24 and 25 with laterally extending stop surfaces 26 which have the form of a spring segment. The oppositely directed convex ends of the arms are substantially horizontal, and are arranged spaced from each other to clear a passage 17 for needle 13 of the sewing machine. Passage 27 corresponds substantially to the dimension of a stitch hole opening 28 provided in cloth feeding plate 2.

The oppositely directed ends of arms 24 and 25 are connected with retaining arm 19 by lateral webs 29 and 30, while the free ends of arms 24 and 25 are downwardly directed and touch cloth feeding plate 2.

For sewing a button 8 on sewing material 31 (FIG. 2), the material is applied laterally against stop surfaces 26 of arms 24 and 25 of stop element 20. Since stop element 20 is in its relaxed position, its lateral stop surfaces cover a maximum stop range, so that, no special care has to be used during the application. Button clamp 4 with button 8 is then lowered in known manner, with cloth pressure plate 11 bearing on arms 24 and 25 of stop element 20 pressing the latter down. Arms 24 and 25 are elastic so that cloth pressure plate 11 likewise bears on sewing material 31, as shown in FIG. 2. Sewing material 31 is thus held sufficiently during the sewing operation, and is thus secured against slipping.

For turning button clamp 4 into an inoperative position, cloth stop 21 is raised by lifting handle bar 17 out of its rest position and turning it about collar screw 15.

While a specific embodiment of the invention has been shown and described in detail to illustrate the application of the principles of the invention, it will be understood that the invention may be embodied otherwise without departing from such principles.

What is claimed is:

1. In a sewing machine having a vertically movable presser element for retaining the material to be sewn, the improvement comprising a resilient stop against which the material is positioned which is resiliently compressible by the presser element in a vertical direction so that the presser element may move the stop downwardly until it engages and retains the material.

2. In a sewing machine according to claim 1, wherein said resilient stop includes a retaining arm having laterally extending resilient arm portions extending parallel to the edge of the material to be sewn.

3. In a sewing machine according to claim 2, wherein said arm portions comprise elastic ring segments.

4. In a sewing machine according to claim 1, wherein said resilient stop includes a spring plate member having intermediate laterally extending portion and outer laterally extending portions connected to the outer ends of said intermediate laterally extending portions, said outer laterally extending portions having side edges defining stop surfaces against which material to be sewn is fed, said outer laterally extending arm portions being formed with outwardly and downwardly extending end portions.

5. A sewing machine, comprising a sewing machine support arm, a cloth feeding plate mounted on said arm over which the material to be sewn is fed, a stop element mounted on said support arm and overlying said cloth feeding plate, said support arm having a laterally extending portion overlying said cloth feeding plate and defining a material stop against which the material to be sewn may be positioned, said stop being compressible in a direction toward said feeding plate.

6. A sewing machine according to claim 5, including a presser plate movable toward and away from said stop and including a portion overlying said stop and the material engaging portion extending beyond said stop and engageable with the material to hold it in a position as said stop is compressed.

7. A sewing machine according to claim 5, including a button clamp overlying said stop and having a presser plate portion movable toward and away from said stop and including a presser plate portion overlying said stop and a presser plate material engaging portion extending beyond said stop and engageable with the material to hold it in position as said stop is compressed.

8. A sewing machine according to claim 7, including a button clamp located above said presser plate including a side jaw on each side for engaging each side of a button in a central button stop located between said side portions against which said button is positioned.

* * * * *